US006409636B1

(12) United States Patent
Risso et al.

(10) Patent No.: US 6,409,636 B1
(45) Date of Patent: Jun. 25, 2002

(54) ELECTRONIC JUMP ROPE

(75) Inventors: Michael D. Risso, Napa; Daniel H. Seifert, Albany; Sharon M. Caroompas, Fairfield, all of CA (US)

(73) Assignee: Oddzon, Inc., Pawtucket, RI (US)

( * ) Notice: Subject to any disclaimer, the term of this patent is extended or adjusted under 35 U.S.C. 154(b) by 0 days.

(21) Appl. No.: 09/535,482

(22) Filed: Mar. 24, 2000

(51) Int. Cl.[7] ..... A63B 5/20

(52) U.S. Cl. ..... 482/82; 482/81; 482/3; 482/7

(58) Field of Search ..... 482/1, 6, 82; 446/213, 446/242; 84/477; 362/102; 110/405

(56) References Cited

U.S. PATENT DOCUMENTS

| | | | | |
|---|---|---|---|---|
| 4,662,260 A | | 5/1987 | Rumsey | 84/1.01 |
| 4,737,134 A | | 4/1988 | Rumsey | 446/409 |
| 5,074,820 A | | 12/1991 | Nakayama | 446/29 |
| 5,108,340 A | | 4/1992 | Farrow | 446/242 |
| 5,137,488 A | | 8/1992 | Yeh | 446/397 |
| 5,145,443 A | | 9/1992 | Vaisnys et al. | 446/242 |
| 5,405,153 A | | 4/1995 | Hauck | 273/460 |
| 5,509,859 A | | 4/1996 | Klees et al. | 472/64 |
| 5,533,920 A | | 7/1996 | Arad et al. | 446/409 |
| 5,533,947 A | * | 7/1996 | Tomlinson et al. | 482/6 |
| 5,785,613 A | | 7/1998 | Francis | 473/414 |
| 5,803,835 A | | 9/1998 | Moton et al. | 473/414 |
| 5,816,580 A | | 10/1998 | Osborne et al. | 273/454 |
| 5,839,976 A | | 11/1998 | Darr | 473/414 |
| 5,895,308 A | | 4/1999 | Spector | 446/397 |
| 5,895,341 A | | 4/1999 | Jones | 482/81 |
| 6,001,048 A | * | 12/1999 | Taylor | 482/81 |

* cited by examiner

*Primary Examiner*—Jerome W. Donnelly
(74) *Attorney, Agent, or Firm*—Marshall, Gerstein & Borun

(57) ABSTRACT

An electronic jump rope that generates beat tracks or sound segments in response to user actuation of switches is disclosed. In one embodiment, the electronic jump rope is provided with a first handle (12), a second handle (14) and a flexible element (16) connected between the first and second handles (12, 14). One of said first and second handles (12, 14) having a first switch (22), a second switch (20), a speaker (50) and a sound generator (90) disposed therein. The sound generator (90) includes a memory (108, 110), a processor (106) and an input/output circuit (106) and is operatively coupled to said first and second switches (20, 22) and said speaker (50), said sound generator (90) being programmed to cause said speaker (50) to play a beat track when said second switch (20) is actuated and programmed to cause said speaker (50) to play a sound segment when said first switch (22) is actuated.

25 Claims, 6 Drawing Sheets

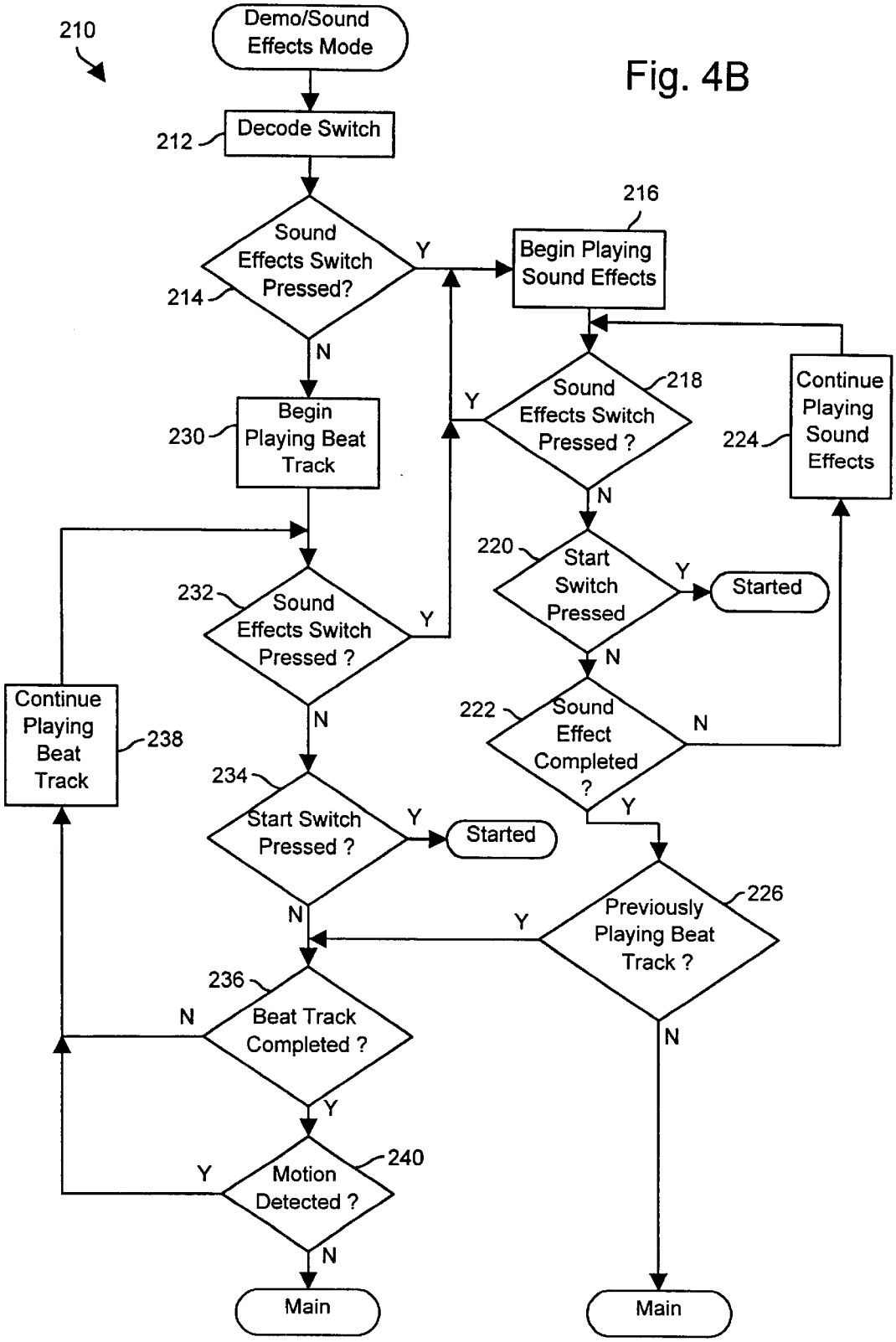
210
Demo/Sound Effects Mode
Fig. 4B
212
Decode Switch
Sound Effects Switch Pressed?
214
Y
N
216
Begin Playing Sound Effects
Sound Effects Switch Pressed ?
218
Y
N
Continue Playing Sound Effects
224
Begin Playing Beat Track
230
Sound Effects Switch Pressed ?
232
Y
N
220
Start Switch Pressed
Y
Started
N
222
Sound Effect Completed ?
N
Y
Continue Playing Beat Track
238
234
Start Switch Pressed ?
Y
Started
N
Previously Playing Beat Track ?
226
Y
N
236
Beat Track Completed ?
N
Y
Motion Detected ?
240
Y
N
Main
Main

ELECTRONIC JUMP ROPE

BACKGROUND OF THE INVENTION

The present invention relates to an electronic jump rope that allows a user, such as a child, to play music, such as beat tracks, or sound segments or effects as the child jumps rope.

Some electronic toys have been designed to allow a user to listen to music while performing physical activities associated with the electronic toys. For example, U.S. Pat. No. 5,533,947 to Tomlinson, et al. discloses a musical jump rope having a sound circuit that can play a number of songs, which the user selects between through the use of a switch. The songs may be played at three different rates, wherein two of the rates depend on the rotation speed of the jump rope (i.e., how fast the user is jumping rope) and one of the rates is independent of the rotation speed of the jump rope. The two rates that depend on the rotation speed of the jump rope play the music at one and two beats per rotation of the jump rope, respectively.

A second example of such an electronic toy is disclosed in U.S. Pat. No. 5,145,433 to Vaisnys, et al., which discloses a musical toy hoop that plays music when the hoop is used. The rate at which the hoop plays music can be increased or decreased by the user. Vaisnys, et al. further discloses that the hoop may be provided with a motion detector to sense when the hoop is not being used so that the music may be stopped.

SUMMARY OF THE INVENTION

In one aspect, the invention is directed to an electronic jump rope having a first handle, a second handle, a flexible element connected between the first and second handles, a first switch disposed in one of the first and second handles, a second switch disposed in one of the first and second handles, a speaker disposed in one of the first and second handles and a sound generator operatively coupled to the first and second switches and the speaker, the sound generator including a memory, a processor and an input/output circuit disposed in one of the first and second handles, the sound generator being programmed to cause the speaker to play a musical beat track when the first switch is actuated and programmed to cause the speaker to play a sound segment simultaneously with the musical beat track when the second switch is actuated so that each actuation of the second switch causes the speaker to audibly superimpose the sound segment over the musical beat track so that both the sound segment and the musical beat track are simultaneously audible.

The second switch may be a switch operable in a first position and in a second position, wherein the sound generator may be programmed to cause the speaker to play a first sound segment when the second switch is actuated to the first position and to cause the speaker to play a second sound segment when the second switch is actuated to the second position.

The sound generator may be programmed with seven musical beat tracks. Each of the seven musical beat tracks may have two sound segments associated therewith.

The electronic jump rope may also include a motion switch disposed in one of the first and second handles and adapted to sense motion of one of the first and second handles, wherein the sound generator may be programmed to cause the speaker to repeatedly play the musical beat track so long as the motion switch senses motion of one of the first and second handles.

In a second aspect, the invention is directed to an electronic jump rope having a first handle, a second handle, a flexible element connected between the first and second handles, a switch disposed in one of the first and second handles, a speaker disposed in one of the first and second handles and a sound generator including a processor, a memory and an input/output circuit disposed in one of the first and second handles and operatively coupled to the switch and the speaker, the sound generator causing the speaker to begin playing a sound effect having a duration of less than three seconds upon each depression of the switch, the sound effect being played independent of movement of the flexible element.

In a third aspect, the invention is directed to an electronic jump rope having a first handle, a second handle, a flexible element connected between the first and second handles, a first switch disposed in the first handle, a second switch operable in a first position and in a second position, the second switch disposed in the first handle, a speaker disposed in the first handle and a sound generator operatively coupled to the first and second switches and the speaker, the sound generator including a processor, a memory and an input/output circuit disposed in the first handle, the sound generator being programmed to cause the speaker to play a beat track at a first playback speed when the first switch is actuated and being programmed to change the first playback speed to a second playback speed when the second switch is actuated in one of the first and second positions, the first and second playback speeds being independent of a rate at which the first and second handles are moved.

In a fourth aspect, the invention is directed to an electronic jump rope having a first handle, a second handle, a flexible element connected between the first and second handles, a first switch disposed in one of the first and second handles, second switch disposed in one of the first and second handles, a speaker disposed in one of the first and second handles and a sound generator operatively coupled to the first and second switches and the speaker, the sound generator including a memory, a processor and an input/output circuit disposed in one of the first and second handles, the sound generator being programmed to cause the speaker to play a musical beat track when the first switch is actuated and programmed to cause the speaker to substitute a sound segment for a portion of the musical beat track when the second switch is actuated.

In a fifth aspect, the invention is directed to a method of using an electronic jump rope having a first handle, a second handle, a flexible element connected between the first and second handles, a first switch, a second switch, a speaker and a sound generator that is capable of causing a beat track and a sound segment to be played. The method includes the steps of a) holding the first handle in a first hand of a user, b) holding the second handle in a second hand of the user, c) jumping rope by repeatedly moving the first and second handles to cause the flexible element to swing around the user about an axis formed between the first and second handles and repeatedly jumping over the flexible member as the flexible member approaches the feet of the user, d) during the step c), actuating the first switch to cause a beat track to be played by the speaker and e) during the step c), actuating the second switch to the first position to cause a first sound segment to be played by the speaker.

The features and advantages of the present invention will be apparent to those of ordinary skill in the art in view of the detailed description of the preferred embodiment, which is made with reference to the drawings, a brief description of which is provided below.

BRIEF DESCRIPTION OF THE DRAWINGS

FIGS. 4A–4C illustrate flowcharts of a computer program that controls the operation of the electronic jump rope of FIG. 1.

DETAILED DESCRIPTION OF THE PREFERRED EMBODIMENTS

Figure 1:
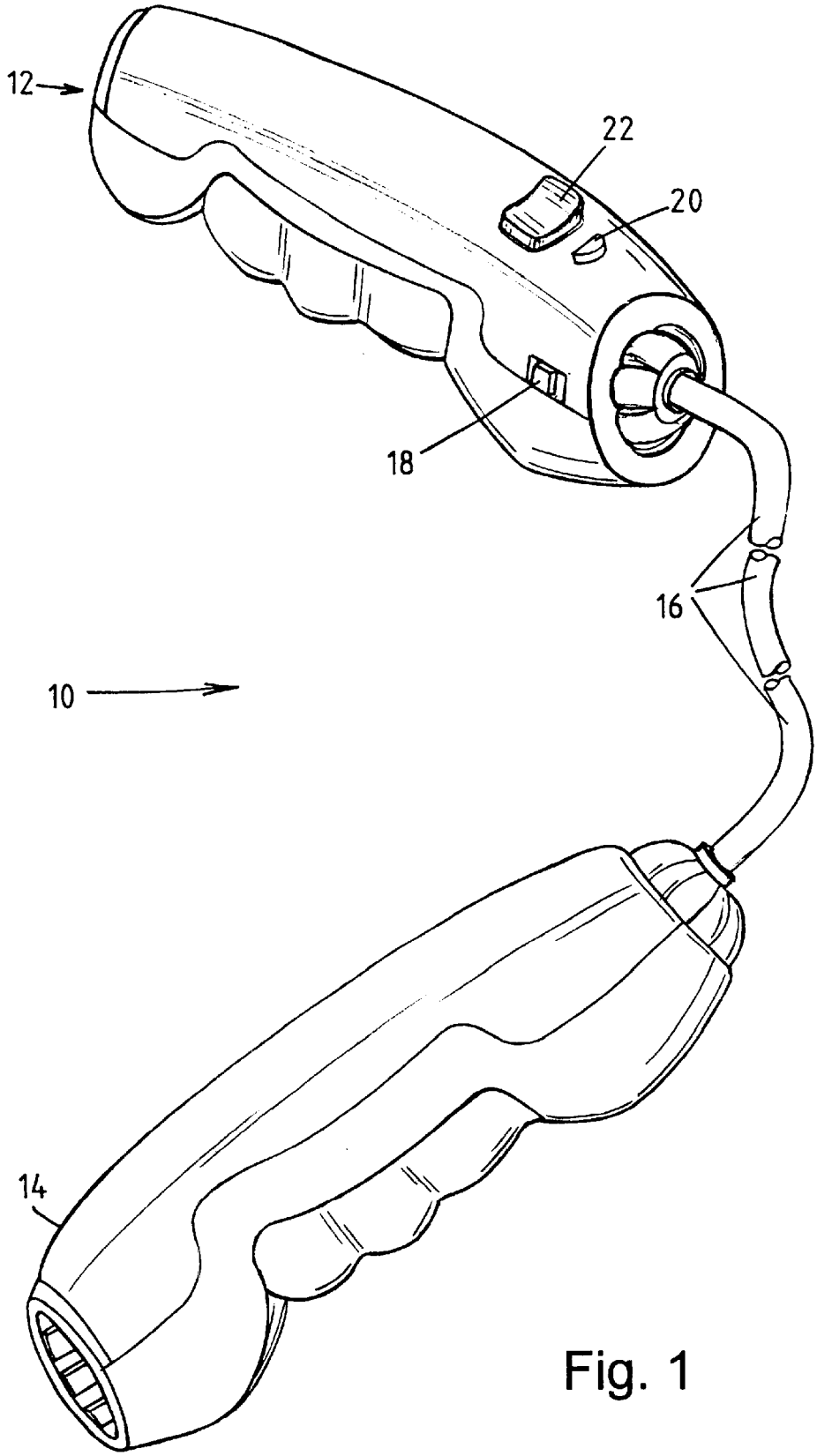
FIG. 1 is a perspective view of an embodiment of an electronic jump rope in accordance with the present invention.

One embodiment of an electronic jump rope 10 in accordance with the invention is shown in FIG. 1. The electronic jump rope 10 comprises a pair of handles 12, 14, one of which is an electronic handle 12, and a flexible element 16, which may be embodied in a rope, tubing or the like, connected to and disposed between the handles 12, 14.

The electronic jump rope 10 is adapted to be used like any conventional jump rope, except that a user can control a sound generating circuit disposed within the electronic handle 12 to produce sounds such as music, beat tracks, sound effects, sound segments or the like while using the electronic jump rope 10. In one embodiment of the present invention, seven different songs or beat tracks, each having two sound effects or sound segments associated therewith, are stored in a sound generating circuit. A beat track may include a number of different notes that are arranged to playback sounds such as rock music sounds, hip-hop sounds and the like. A beat track may be 10–15 seconds in length and may be recursively played to produce an extended beat track that lasts longer than 10–15 seconds. Sound effects or sound segments may be musical sequences that include one or more notes. The sound segments may be shorter in duration than the beat tracks. All or some of the sound segments may have the same or different lengths. For example, a first sound segment may sound like a maraca, which is brief, while a second sound segment may be a short tune or melody that may be longer than the first sound segment. Additionally, the sound segments may be portions of one or more different beat tracks.

To allow the user to control the sound generating circuit to play back the beat tracks and sound effects, the electronic handle 12 may be provided with a mode select switch 18, a rocker switch 20 and a start switch 22. The start switch 22 may be a normally open push button switch that closes momentarily when the user depresses the start switch 22. The rocker switch 20 may have left and right normally open push button switches associated therewith. If the rocker switch 20 is pivoted to the left, the left switch is closed. Similarly, if the rocker switch 20 is pivoted to the right, the right switch is closed.

Figure 2:
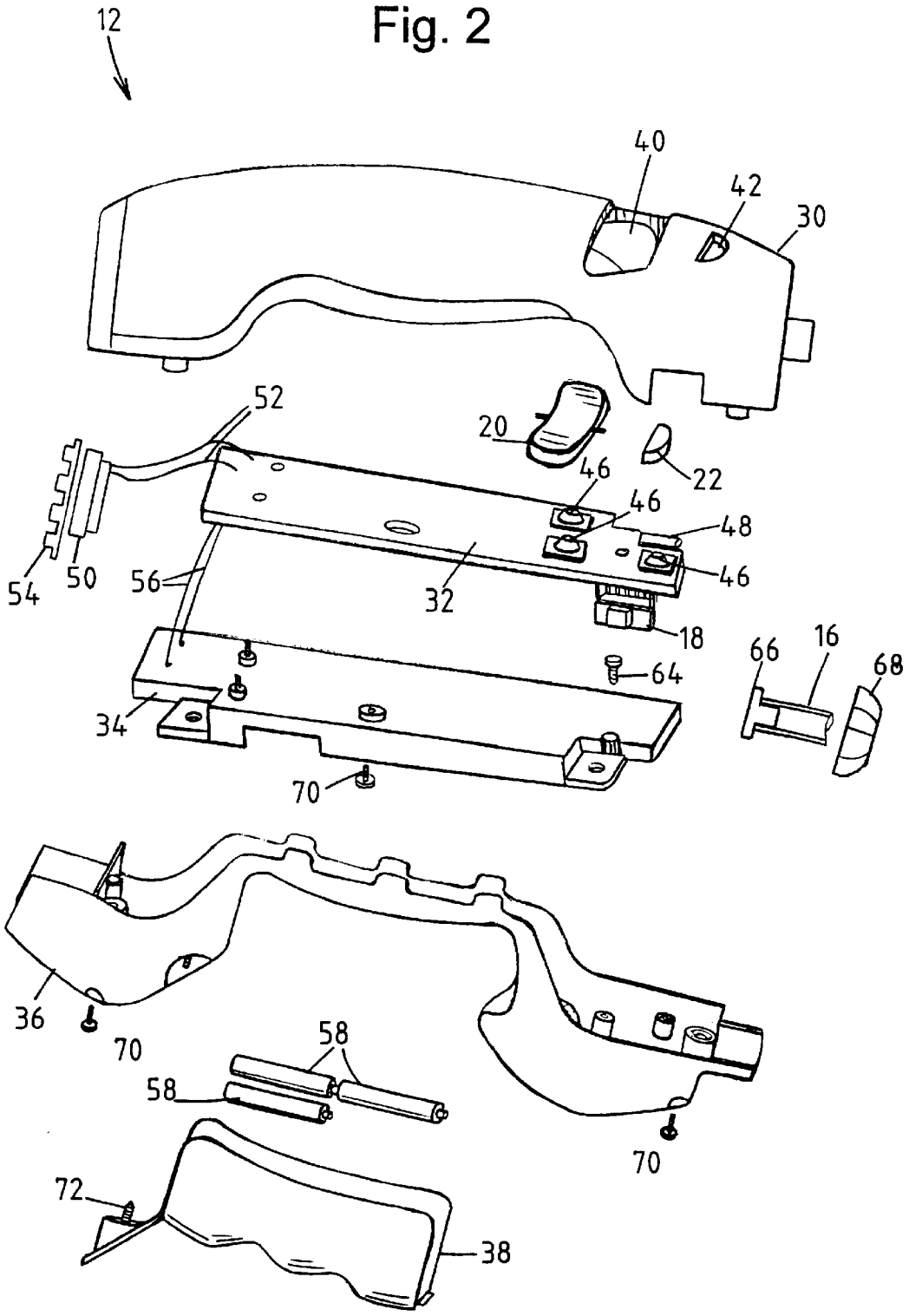
FIG. 2 is an assembly view of the electronic handle of the electronic jump rope of FIG. 1.

Referring to FIG. 2, the electronic handle 12 may include a top housing 30, a printed circuit board 32, a battery compartment 34, a bottom housing 36 and a battery cover 38.

The rocker and start switches 20, 22 fit into the openings 40, 42 in the top housing 30 and, when depressed, the switches 20, 22 close contact patches 46 that may be located on the printed circuit board 32. The mode select switch 18 may be connected to the printed circuit board 32 and may be mechanically positioned to protrude from the electronic handle 12 when the top and bottom housings 30, 36 are assembled.

Also disposed on the printed circuit board 32 is a motion switch 48, which may include a conductive spring **48*a* (FIG. 3) disposed within a metal cylinder 48*b* (FIG. 3) so that the conductive spring 48*a* does not make contact with the metal cylinder 48*b* when the motion switch 48 is stationary. In response to lateral forces, which would result from moving the electronic handle 12 to jump rope, the conductive spring 48*a* may contact the metal cylinder 48*b* to inform circuitry on the printed circuit board 32 that the electronic handle 12 is moving. Further detail regarding circuitry that may be disposed on the printed circuit board 32 is described below in conjunction with FIG. 3**.

Returning to FIG. 2, the electronic handle 12 further includes a speaker 50 that may be connected to the printed circuit board 32 by a pair of wires 52. A speaker housing 54 may be provided to protect the speaker 50 when the electronic handle 12 is assembled.

The battery compartment 34 may be electrically connected to the printed circuit board 32, via a pair of wires 56. The battery compartment 34 may be adapted to hold three AAA batteries 58, which may be connected in series to provide 4.5V to the printed circuit board 32. A screw 64 may be provided to fasten the battery compartment 34 to the bottom housing 36.

The top and bottom housings 30, 36 may be designed to snap together and trap the battery compartment 34, the printed circuit board 32 and other associated components therebetween. Also shown in FIG. 2 is an end of the flexible element 16, into which a plug 66 may be inserted. The plug 66 may be trapped between the top and bottom housings 30, 36, respectively, to retain the flexible element 16 in the electronic handle 12. A collar 68 may be fitted over onto the electronic handle 12 to keep the top and bottom housings 30, 36, respectively, together. After the top and bottom housings 30, 36 are snapped together screws 70 may be used to fasten the battery compartment 34 to the top housing 30 and to fasten the bottom housing 36 to the top housing 30.

After the electronic handle 12 has been assembled and the batteries 58 have been installed, the battery cover 38 may be installed into the bottom housing 36. The battery cover 38 may have a screw 72 that fastens the battery cover 38 to the bottom housing 36.

Figure 3:
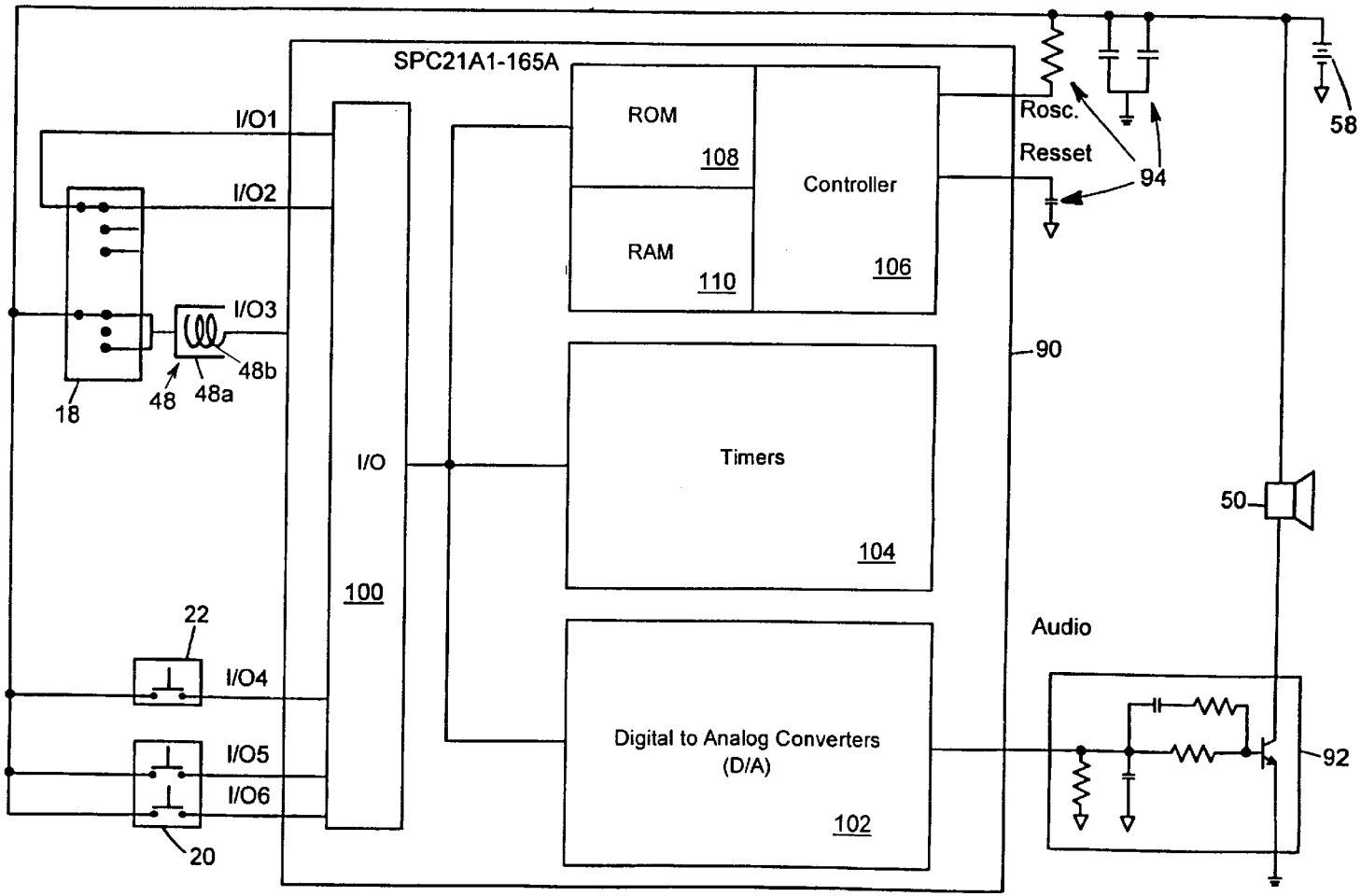
FIG. 3 is a circuit diagram of the electronics of the electronic jump rope of FIG. 1.

Turning now to the description of the electrical components of the electronic handle 12, as shown in FIG. 3, in addition to the switches 18, 20 and 22, the motion switch 48, the speaker 50 and the batteries 58, the electronic handle may include a sound generator 90, an amplifier 92 and a miscellaneous support circuitry 94. The sound generator 90 may be embodied in a 20 KB sound controller available from Sunplus Technology Co., Ltd., under the model number SPC21A1, the manufacturer's specification of which is expressly incorporated herein by reference. The sound generator 90 may include an input/output (I/O) circuit 100, one or more digital-to-analog (D/A) converters 102, one or more timer circuits 104, a controller or processor 106, a read only memory (ROM) 108 and a random access memory (RAM) 110.

The ROM 108 may be 20 kilobytes (KB) in size and may contain both program instructions (the functionality of which is described below with respect to FIGS. 4A–4C) and audio data. Audio data may be digital data representative of the seven beat tracks and their associated sound effects. When program instructions indicate that a particular beat track or sound effect is to be played on the speaker 50, audio data representative of the beat track or sound effect is coupled to the D/A converter 102, which converts the audio data into an analog signal that may be coupled from the sound generator 90 to the amplifier 92. The amplifier 92 amplifies the signal from the D/A converter 102 to a level appropriate for the speaker 50. The amplifier 92 may be a conventional transistor amplifier, the design of which is well within the knowledge of those having ordinary skill in the art. The amplifier 92 may also be integrated with the sound generator 90.

The mode select switch 18 may be a three-throw, two pole switch that informs the sound generator 90 of the mode the electronic handle 12 and whether or not the motion switch 48 is read by the sound generator 90. In FIG. 3, the mode select switch 18 is shown in the challenge mode. The middle state of the mode select switch 18 may represent the demonstration mode wherein the motion switch 48 is not read by the sound generator 90. The remaining mode may be the sound effects mode, in which the mode select switch 18 may send the identical information to the sound generator as when the mode select switch 18 is in the demonstration mode state, except for the fact that the in the sound effects mode, the sound generator 90 may read the motion switch 48.

The sound generator 90 may be programmed to recognize input from the start switch 20 as a start signal. Additionally, the sound generator 90 may be programmed to recognize input from the rocker switch 20. Depending on the mode of the sound generator 90, which is dictated by the mode select switch 18, the output from the rocker switch 20 may be interpreted by the sound generator 90 as either a request for sound effects or as a command to change the playback speed of a beat track.

Figure 4A:
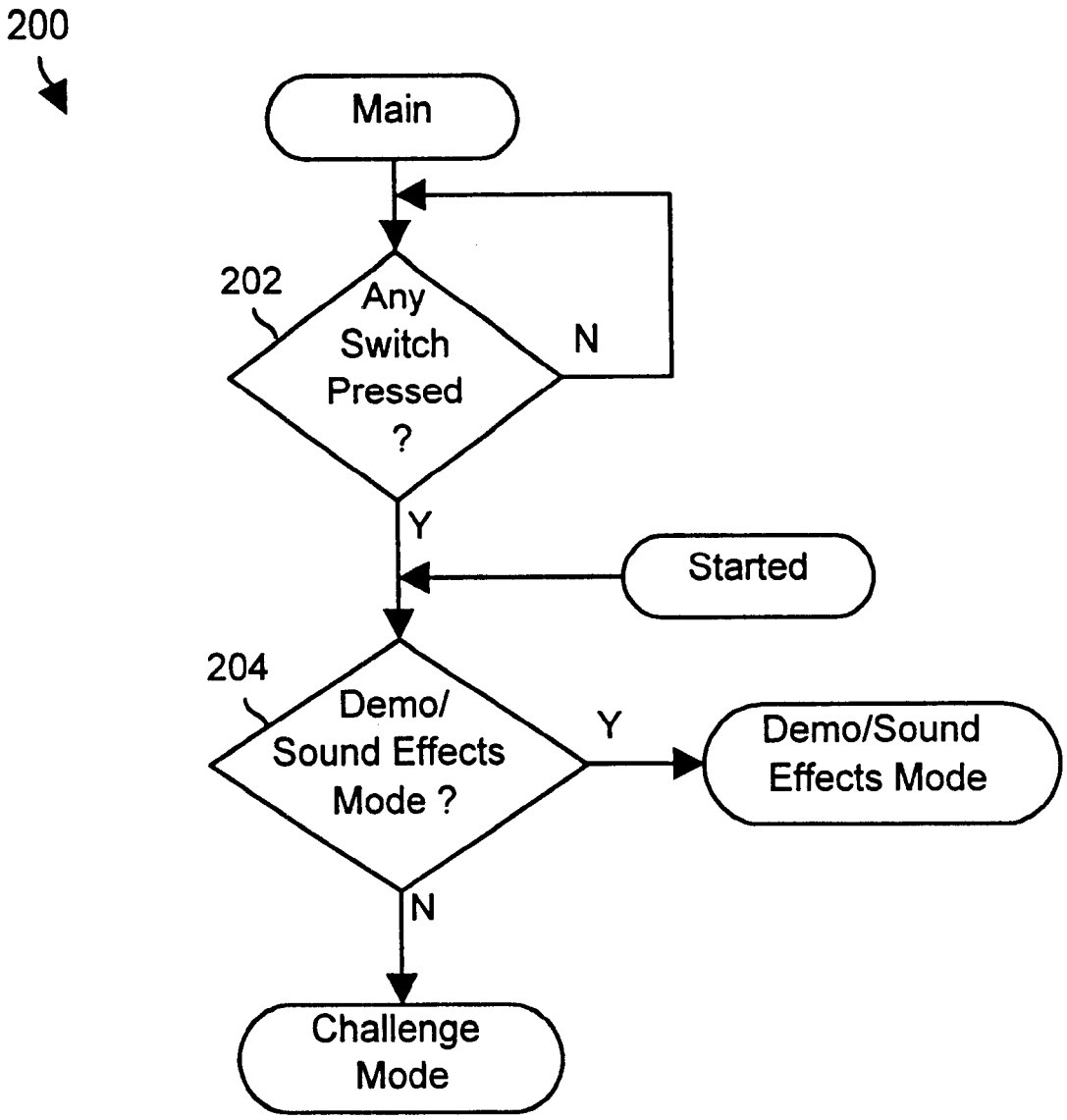
Figure 4C:
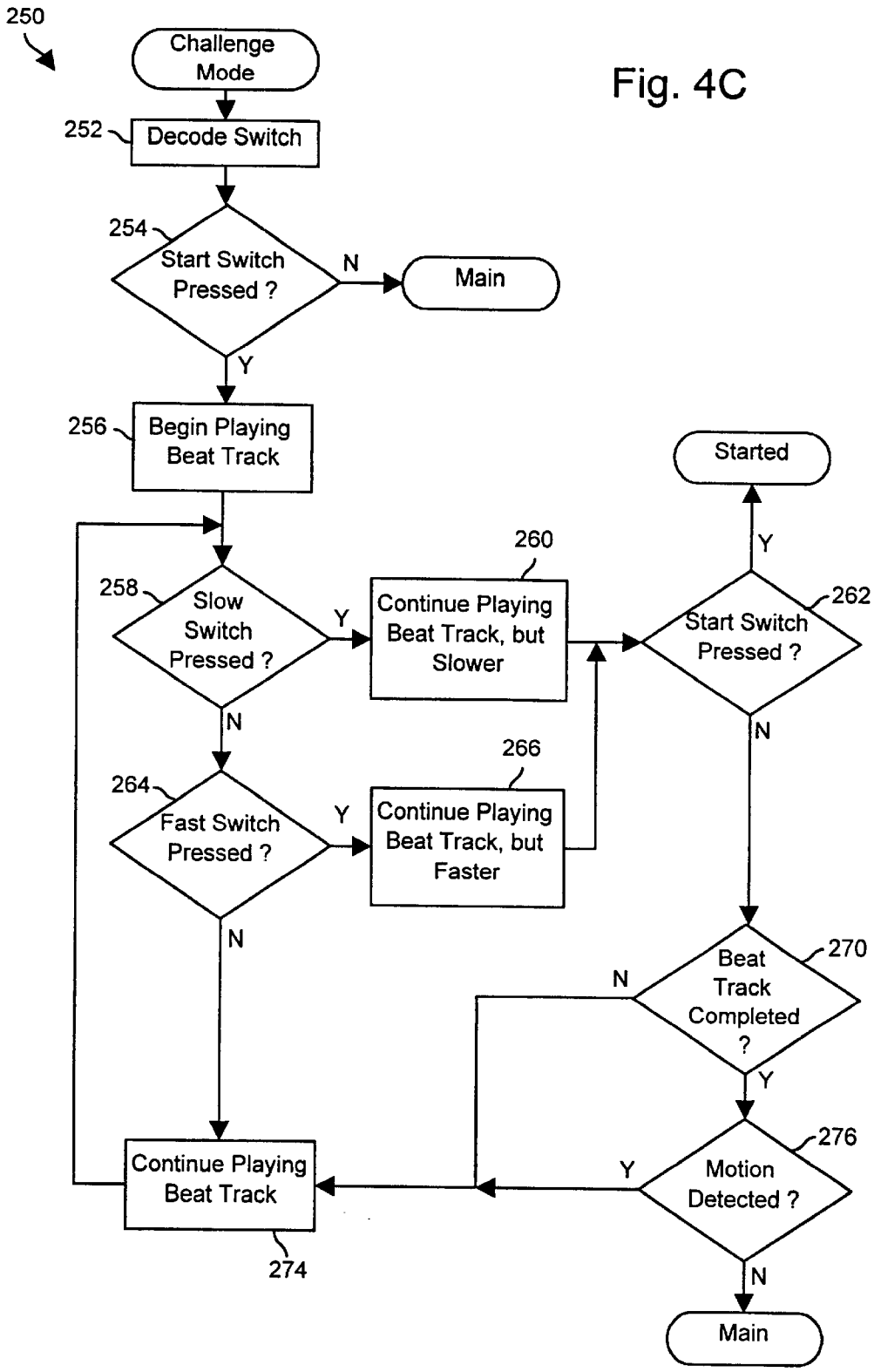

A flowchart of the computer program that may be executed by the controller 106 is illustrated in FIGS. 4A–4C. Referring to FIG. 4A, the computer program may include a main routine 200 that is performed when batteries 58 are installed into the electronic handle 12. At step 202, the main routine 200 waits for a user to actuate either the rocker switch 20 or the start switch 22. Upon the actuation of either the rocker switch 20 or the start switch 22, the program passes to step 204, which determines if the mode select switch 18 (FIGS. 1–3) is in either the demonstration mode or the sound effects mode. If the step 204 determines that the mode select switch 18 is in the demonstration or sound effects modes, the program may branch to a demonstration and sound effects routine 210, shown in FIG. 4B.

Turning now to FIG. 4B, step 212 may decode the switch that was pressed at step 202 (FIG. 4A). After the switch has been decoded, step 214 determines whether or not the decoded switch was the rocker switch 20 (FIGS. 1–3), which is a sound effects switch 20 in the demonstration and sound effects modes.

If the sound effects switch 20 was pressed control passes from step 214 to step 216, which begins playing the sound effect associated with the sound effect switch 20. As the sound effect is being played, step 218 determines if the sound effects switch 20 has been pressed again. If the sound effects switch 20 has been pressed again, control may pass back to step 216, which begins playing the sound effect again. If however, the sound effects switch 20 has not been pressed again, control may pass from step 218 to step 220, which determines whether the start switch 22 has been pressed. If the start switch 22 has been pressed, control may pass back to step 204 (FIG. 4A), wherein operation of the software determines the state of the mode select switch 18.

If, however, the start switch 22 has not been pressed, control may pass from step 220 to step 222, which determines if the sound effect that was started playing at step 216 is still playing. If the sound effect has not completed playing, the program branches from step 222 to step 224, which continues playing the sound effect started in the step 216. Collectively, steps 216–224 function to play a sound effect and to monitor the sound effects and start switches 20, 22, respectively.

If step 222 determines that the sound effect started by step 216 has completed playing, the program branches to step 226, which determines if the sound effect started by step 216 started playing while a beat track was playing. If a beat track was previously playing, the program may branch to a beat track portion of the flowchart, which is described below. If step 226 determines that a beat track was not previously playing, control passes back to the main routine 200.

Returning to step 214, if the sound effects switch 20 was not pressed, step 214 branches to step 230, which begins playing a beat track. While the beat track started at step 230 is playing, step 232 checks to see if the sound effects switch 20 has been pressed. If the sound effects switch 20 has been pressed, step 232 branches to step 216, which, as described before, begins playing a sound effect. The sound effect may be played as the beat track started at step 230 is playing. Alternatively, the beat track may be stopped while the beat track is played and restarted after the sound effect has completed.

If step 232 does not detect that the sound effects switch 20 has been pressed, the program branches to step 234, which determines if the start switch 22 has been pressed. If the start switch 22 has been pressed, control passes to step 204 (FIG. 4A). However, if the start switch 22 has not been pressed, step 236 determines if the beat track started at step 230 has completed playing. If the beat track has not completed playing, control passes from step 236 to step 238, which continues playing the beat track and passes control to step 232. Collectively, steps 230–238 perform the function of playing a beat track and monitoring and responding to key presses on the sound effects and start switches, 20, 22, respectively.

As noted with respect to step 226, if a sound effect was played while a beat track was playing, step 226 branches to step 236. The playing of a sound effect during a beat track may suspend the play of the beat track and may restart beat track play after the sound effect is complete. Alternatively, the beat track may play contemporaneously with the beat track. Additionally, while step 226 is shown being connected to step 236, step 226 could be connected to step 230. If step 226 is connected to step 230, a beat track will begin playing from the beginning after a sound effect played by step 216 is complete.

If step 236 determines that the beat track has completed playing, the program branches to step 240, which queries whether motion of the electronics handle 12 has been detected. As noted with respect to FIGS. 2 and 3, the electronics handle 12 contains the motion switch 48 that detects motion of the electronics handle 12. If motion is detected, step 238 continues to play the beat track. Accordingly, if a user is jumping rope, the beat track will continue to play recursively. If no motion has been detected, the program branches to the main routine 200. In practice, there is a variety of ways in which software may read and react to the motion switch 48. For example, the motion switch 48 may reset a decrementing timer started by step 230 each time the motion switch 48 detects motion, wherein as long as the decrementing timer does not reach zero, the beat track continues to play. Importantly, the motion switch 48 is not enabled in the demonstration mode. Therefore, the test performed by step 240 will always fail in the demonstration mode. Accordingly, a beat track will not be recursively played by the electronic jump rope 10 during the demonstration mode.

Returning now to FIG. 4A, if the step 204 determines that the mode select switch 18 (FIGS. 1–3) is not in the demonstration or sound effects modes, control passes to a challenge mode routine 250, as shown in FIG. 4C. In the challenge mode routine 250, step 252 may decode the switch that was pressed at step 202. Step 254 determines if the switch decoded by step 252 was the start switch 22. If the decoded switch was not the start switch 22, the program branches to the main routine 200 (FIG. 4A).

If, however, step 254 determines that the start switch 22 was pressed, the program branches to step 256, which begins to play a beat track. While the beat track is playing, step 258 determines if the slow switch, which is closed when the rocker switch 20 is moved one way, has been pressed. If the slow switch has been pressed, the program branches to step 260, which continues playing the beat track, but plays the beat track at a slower rate than it was previously being played. After step 260 is complete, control passes to step 262.

If the slow switch has not been pressed, control passes from step 258 to step 264, which determines if the fast switch, which is closed when the rocker switch 20 is moved the opposite way of the way that closes the slow switch, has been pressed. If the fast switch has been pressed, the program branches to step 266, which continues playing the beat track, but plays the beat track at a faster rate than it was previously being played. After step 266 completes control passes to step 262.

Step 262 determines if the start switch 22 has been pressed. If the start switch 22 has been pressed, control passes to step 204 (FIG. 4A). If, however, the start switch 22 has not been pressed, control passes to step 270, which determines whether the beat track that was started by the step 256 has completed playing. If the beat track has not completed playing, control passes from step 270 to step 274, which continues playing the beat track and passes control to step 258.

If, however, the beat track started by step 256 is complete, control passes from step 270 to step 276, which determines whether motion has been detected, by the motion switch 48 (FIGS. 2 and 3). If motion is detected, the program branches to step 274. However, if motion is not detected, the program branches to the main routine 200 (FIG. 4A).

Having described the mechanical and electrical components of the electronic jump rope 10, the following is a description of how a user would use each mode of operation described above. To use the electronic jump rope 10, a user would hold a handle 12 or 14 in each hand and jump rope by repeatedly moving the handles 12, 14 to cause the flexible element 16 to swing around the users head about an axis formed between the handles 12, 14 and repeatedly jumping over the flexible member 16 as the flexible member 16 approaches the feet of the user. While the user is jumping rope he or she may use the rocker switch 20 and the start switch 22 to play sound segments, sound effects or beat tracks, depending on the mode in which the electronic jump rope is being operated. A description of each of the modes and the functionality of the rocker and start switches 20, 22, respectively, in each mode follows.

Demonstration Mode

When the electronic jump rope 10 is in the demonstration mode and the user presses the start switch 22, the electronic handle 12 may play a 10–15 second beat track. Seven 10–15 second beat tracks may be stored in the electronic handle 12 and with each depression of the start switch 22 one of the seven beat tracks may be played. The beat tracks may be played in sequence to avoid excessive repetition of a particular beat track on consecutive depressions of the start switch 22. For example, if a first beat track has just been played, a subsequent depression of the start switch 22 may cause a second beat track to be played. Accordingly, a beat track will only be repeated after the start switch 22 has been depressed seven times.

Each of the beat tracks may have two sound effects or sound segments associated therewith (e.g., there may be eleven different sound effects available for play, three of which are associated with two beat tracks). Each of the two sound effects may be associated with a position of the rocker switch 20. Two sound segments associated with a beat track may play for the same time duration or may play for different time durations. For example, a first sound segment may be a brief sound effect like a maraca, while a second sound segment may be a short tune or melody that may be longer than the first sound segment. For example, if there are eleven sound effects available, seven may be short tunes or melodies and three may be brief sound effects. When the rocker switch 22 is pivoted to the left, a first sound effect may be played. Similarly, when the rocker switch 20 is pivoted to the right, a second sound effect may be played. The two sound effects may be played while their associated beat track is playing or may be played in the absence of their beat track. The sound effect may be either played at the same time the beat track is played or may interrupt the beat track to play the sound effect and then restart the beat track from the beginning. Either way the rocker switch 20 allows the user to play sound effects or sound segments at the will of the user.

Sound Effects Mode

The operation of the sound effects mode may be substantially identical to the operation of the demonstration mode described above, except that in the sound effects mode the electronic jump rope 10 may sense whether the electronic jump rope 10 is being used or moved. The sound effects mode may continuously repeat a beat track as long as the electronic jump rope 10 senses movement. The beat tracks used in the sound effects mode may be identical to those used in the demonstration mode, except that in the sound effects mode the beat tracks may be recursively or continuously played as long as the electronic jump rope 10 is moved periodically. When a first beat track is playing, the user may actuate the start switch 22 to select any of the available beat tracks, each of which may continuously play so long as the electronic jump rope 10 is moved periodically.

Just as in the demonstration mode, in the sound effects mode each beat track may have two associated sound effects or sound segments. In fact, the sound effects associated with a particular beat track may be identical between the demonstration mode and the sound effects mode. As with the demonstration mode, the rocker switch 20 may cause sound effects to be played in the sound effects mode. The sound effects may be played either with or without a repeating beat track. Also, as with the demonstration mode, sound effects may be either played at the same time the beat track is played or may interrupt the beat track to play sound effects and then restart the beat track from the beginning. Again, either way, the rocker switch 20 allows the user to play sound effects at the will of the user.

In sound effects mode, a user may actuate the start switch 22 and then may jump rope to any one of the beat tracks that will be continuously played. Additionally, the user can add various sound effects to the beat tracks by moving the rocker switch 20 to either the right or left. Further, a user need not play a beat track and may play only sound effects while the user jumps rope.

Challenge Mode

In challenge mode, a user may actuate the start switch 22 to select a particular beat track that the user enjoys, thereafter the user may begin jumping rope. As with the demonstration and sound effects modes, the user may select a beat track that the user enjoys by repeatedly actuating the start switch 22 to cycle through the beat tracks. As with the sound effects mode, so long as the user moves the electronic jump rope 10 the beat track may continuously play. A user may actuate the rocker switch 20 in first and second directions to increase or decrease the rate at which the beat track is played, the idea being that the user tries to jump rope at a pace set by the beat track. Accordingly, if a user desires to jump to the speed of the beat track, the user may actuate the rocker switch 20 in a first direction to increase the rate of the beat track and thereby make jumping with the speed of the beat track more challenging. Similarly, if the user desires to slow the speed of the beat track, the user may actuate the rocker switch 20 in a second direction thereby making the act of jumping with the speed of the beat track less challenging.

Modifications and alternative embodiments of the invention will be apparent to those having ordinary skill in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. An electronic jump rope, comprising:

a first handle;

a second handle;

a flexible element connected between said first and second handles;

a first switch disposed in one of said first and second handles;

a second switch disposed in one of said first and second handles;

a speaker disposed in one of said first and second handles; and a sound generator operatively coupled to said first and second switches and said speaker, said sound generator including a memory, a processor and an input/output circuit disposed in one of said first and second handles, said sound generator being programmed to cause said speaker to play a musical beat track when said first switch is actuated and programmed to cause said speaker to play a sound segment simultaneously with the musical beat track when said second switch is actuated so that each actuation of said second switch causes said speaker to audibly superimpose the sound segment over the musical beat track so that both the sound segment and the musical beat track are simultaneously audible.

2. An electronic jump rope as defined in claim 1, wherein said second switch comprises a switch operable in a first position and in a second position and wherein said sound generator is programmed to cause said speaker to play a first sound segment when said second switch is actuated to said first position and to cause said speaker to play a second sound segment when said second switch is actuated to said second position.

3. An electronic jump rope as defined in claim 2, wherein said sound generator is programmed with seven musical beat tracks.

4. An electronic jump rope as defined in claim 3, wherein each of the seven musical beat tracks has two sound segments associated therewith.

5. An electronic jump rope as defined in claim 4 further comprising a motion switch disposed in one of said first and second handles and adapted to sense motion of one of said first and second handles, wherein said sound generator is programmed to cause said speaker to repeatedly play the musical beat track so long as said motion switch senses motion of one of said first and second handles.

6. An electronic jump rope, comprising:

a first handle;

a second handle;

a flexible element connected between said first and second handles;

a switch disposed in one of said first and second handles;

a speaker disposed in one of said first and second handles; and a sound generator including a processor, a memory and an input/output circuit disposed in one of said first and second handles and operatively coupled to said switch and said speaker, said sound generator causing said speaker to begin playing a sound effect having a duration of less than three seconds upon each depression of said switch, the sound effect being played independent of movement of said flexible element.

7. An electronic jump rope as defined in claim 6, wherein said switch comprises a switch operable in a first position and in a second position and wherein said sound generator is programmed to cause said speaker to play a first sound effect when said switch is actuated to said first position and to cause said speaker to play a second sound effect when said switch is actuated to said second position.

8. An electronic jump rope as defined in claim 7, wherein said sound generator is programmed with eleven sound effects.

9. An electronic jump rope as defined in claim 8, further comprising a second switch, wherein said sound generator is programmed to cause said speaker to play a musical beat track when said second switch is actuated.

10. An electronic jump rope as defined in claim 9, wherein said sound generator is programmed with seven musical beat tracks.

11. An electronic jump rope as defined in claim 10, wherein each of the seven musical beat tracks has two sound effects associated therewith.

12. An electronic jump rope, comprising:

a first handle;

a second handle;

a flexible element connected between said first and second handles;

a first switch disposed in said first handle;

a second switch operable in a first position and in a second position, said second switch disposed in said first handle;

a speaker disposed in said first handle; and a sound generator operatively coupled to said first and second switches and said speaker, said sound generator including a processor, a memory and an input/output circuit disposed in said first handle, said sound generator being programmed to cause said speaker to play a beat track at a first playback speed when said first switch is actuated and being programmed to change said first playback speed to a second playback speed when said second switch is actuated in one of said first and second positions, the first and second playback speeds being independent of a rate at which said first and second handles are moved.

13. An electronic jump rope as defined in claim 12, wherein the second playback speed is faster that the first playback speed when said second switch is actuated in said first position and wherein said second playback speed is slower than the first playback speed when said second switch is actuated in said second position.

14. An electronic jump rope as defined in claim 13, further comprising a motion switch disposed in said first handle and adapted to sense motion of said first handle, said sound generator being programmed to cause said speaker to repeatedly play the beat track so long as said motion switch senses motion of said first handle.

15. An electronic jump rope, comprising:

a first handle;

a second handle;

a flexible element connected between said first and second handles;

a first switch disposed in one of said first and second handles;

a second switch disposed in one of said first and second handles;

a speaker disposed in one of said first and second handles; and a sound generator operatively coupled to said first and second switches and said speaker, said sound generator including a memory, a processor and an input/output circuit disposed in one of said first and second handles, said sound generator being programmed to cause said speaker to play a musical beat track when said first switch is actuated and programmed to cause said speaker to substitute a sound segment for a portion of the musical beat track when said second switch is actuated.

16. An electronic jump rope as defined in claim 15, wherein the musical beat track has a beginning and said sound generator is programmed to cause said speaker to restart the musical beat track from the beginning after said speaker has completed playing the sound segment.

17. An electronic jump rope as defined in claim 16, wherein said second switch comprises a switch operable in a first position and in a second position and wherein said sound generator is programmed to cause said speaker to play a first sound segment when said second switch is actuated to said first position and to cause said speaker to play a second sound segment when said second switch is actuated to said second position.

18. An electronic jump rope as defined in claim 17, wherein said sound generator is programmed with seven musical beat tracks.

19. An electronic jump rope as defined in claim 18, wherein each of the seven musical beat tracks has two sound segments associated therewith.

20. An electronic jump rope as defined in claim 19, further comprising a motion switch disposed in one of said first and second handles and adapted to sense motion of one of said first and second handles, wherein said sound generator is programmed to cause said speaker to repeatedly play the musical beat track so long as said motion switch senses motion of one of said first and second handles.

21. A method of using an electronic jump rope having a first handle, a second handle, a flexible element connected between said first and second handles, a first switch, a second switch, a speaker and a sound generator that is capable of causing a beat track and a sound segment to be played, comprising:

a) holding said first handle in a first hand of a user;

b) holding said second handle in a second hand of the user;

c) jumping rope by repeatedly moving said first and second handles to cause said flexible element to swing around the user about an axis formed between said first and second handles and repeatedly jumping over said flexible member as said flexible member approaches the feet of the user;

d) during said step c), actuating said first switch to cause a beat track to be played by the speaker; and e) during said step c), actuating said second switch to said first position to cause a first sound segment to be played by said speaker.

22. A method as described by claim 21, further comprising the step of actuating said second switch to said second position to cause a second sound segment to be played by said speaker.

23. An electronic jump rope, comprising:

a first handle;

a second handle;

a flexible element connected between said first and second handles;

a first switch disposed in one of said first and second handles;

a second switch disposed in one of said first and second handles;

a speaker disposed in one of said first and second handles; and a sound generator operatively coupled to said first and second switches and said speaker, said sound generator including a memory, a processor and an input/output circuit disposed in one of said first and second handles, said sound generator being programmed to cause said speaker to play a musical sequence when said first switch is actuated and programmed to cause said speaker to play a sound segment simultaneously with the musical sequence when said second switch is actuated so that each actuation of said second switch causes said speaker to audibly superimpose the sound segment over the musical sequence so that both the sound segment and the musical sequence are simultaneously audible.

24. An electronic jump rope, comprising:

a first handle;

a second handle;

a flexible element connected between said first and second handles;

a first switch disposed in said first handle;

a second switch operable in a first position and in a second position, said second switch disposed in said first handle;

a speaker disposed in said first handle; and a sound generator operatively coupled to said first and second switches and said speaker, said sound generator including a processor, a memory and an input/output circuit disposed in said first handle, said sound generator being programmed to cause said speaker to play a musical sequence at a first playback speed when said first switch is actuated and being programmed to change said first playback speed to a second playback speed when said second switch is actuated in one of said first and second positions, the first and second playback speeds being independent of a rate at which said first and second handles are moved.

25. An electronic jump rope, comprising:

a first handle;

a second handle;

a flexible element connected between said first and second handles;

a first switch disposed in one of said first and second handles;

a second switch disposed in one of said first and second handles;

a speaker disposed in one of said first and second handles; and a sound generator operatively coupled to said first and second switches and said speaker, said sound generator including a memory, a processor and an input/output circuit disposed in one of said first and second handles, said sound generator being programmed to cause said speaker to play a musical sequence when said first switch is actuated and programmed to cause said speaker to substitute a sound segment for a portion of the musical sequence when said second switch is actuated.

* * * * *